US009486067B2

(12) United States Patent
Ferrari et al.

(10) Patent No.: US 9,486,067 B2
(45) Date of Patent: Nov. 8, 2016

(54) AUTOMATIC PUNCHING MACHINE FOR MAKING BRUSHES AND METHOD FOR AUTOMATICALLY MAKING BRUSHES BY PUNCHING

(71) Applicant: BORGHI S.p.A., Castelfranco Emilia (IT)

(72) Inventors: Enzo Ferrari, Castelfranco Emilia (IT); Paolo Anderlini, Anzola Emilia (IT)

(73) Assignee: BORGHI S.p.A., Castelfranco Emilia (IT)

( * ) Notice: Subject to any disclaimer, the term of this patent is extended or adjusted under 35 U.S.C. 154(b) by 358 days.

(21) Appl. No.: 14/102,207

(22) Filed: Dec. 10, 2013

(65) Prior Publication Data

US 2014/0167488 A1 Jun. 19, 2014

(30) Foreign Application Priority Data

Dec. 18, 2012 (IT) ..... BO12A0680

(51) Int. Cl.
*A46D 3/00* (2006.01)
*A46D 3/04* (2006.01)
(Continued)

(52) U.S. Cl.
CPC . *A46D 3/04* (2013.01); *A46D 3/02* (2013.01); *A46D 3/082* (2013.01)

(58) Field of Classification Search
CPC ..... A46D 3/02; A46D 3/04; A46D 3/08; A46D 3/082; A46B 3/04
USPC ..... 300/2, 4, 8
See application file for complete search history.

(56) References Cited

U.S. PATENT DOCUMENTS 4,310,377 A * 1/1982 Lorenz ..... A46D 3/045 15/159.1
5,108,155 A * 4/1992 Hettes ..... B29C 45/14385 264/243
6,145,935 A * 11/2000 Boucherie ..... A46D 3/082 300/2

(Continued)

FOREIGN PATENT DOCUMENTS

EP 1493355 B1 3/2006
IT WO 2010067311 A1 * 6/2010 ..... A46D 3/06
WO WO 2011/045743 A2 4/2011

OTHER PUBLICATIONS

"DimensionEngineering SyRen 10 / SyRen 25 motor driver user's guide," Jul. 24, 2007, retrieved from: http://www.dimensionengineering.com/datasheets/SyRen10-25.pdf on Aug. 15, 2013, 20 pages.

(Continued)

*Primary Examiner* — Michael Jennings
(74) *Attorney, Agent, or Firm* — Dascenzo Intellectual Property Law, P.C.; Ian D. Gates

(57) ABSTRACT

An automatic punching machine for making brushes comprises a slide connected to a first actuator for receiving bundles of fibers and feeding them to a brush body; a needle connected to a second actuator for inserting the bundles of fibers inside corresponding openings of the brush body; a first and a second sensor for detecting a first and second signal representing the position of the slide and of the needle; a memory containing data of a trend of a control parameter representing the position of the slide as a function of a synchronization parameter having a predetermined relationship with a parameter representing the needle position; a processor programmed for deriving in real time values of the synchronization parameter and for controlling the first actuator by feedback as a function of the first and second signals, the synchronization parameter and the data contained in the memory.

20 Claims, 4 Drawing Sheets

(51) Int. Cl.
*A46D 3/02* (2006.01)
*A46D 3/08* (2006.01)

(56) References Cited

U.S. PATENT DOCUMENTS 6,290,302 B1 * 9/2001 Boucherie ..... A46D 3/045 300/11
6,893,100 B1 * 5/2005 Hottmann ..... A46D 3/04 300/5
2001/0026093 A1 * 10/2001 Boucherie ..... A46D 3/082 300/5
2003/0170339 A1 * 9/2003 Ebner ..... B29C 45/1618 425/556
2004/0079331 A1 * 4/2004 Kaiser ..... F02D 11/10 123/399
2005/0001467 A1 * 1/2005 Boucherie ..... A46D 3/02 300/3
2005/0001468 A1 * 1/2005 Boucherie ..... A46D 3/042 300/5
2005/0168049 A1 * 8/2005 Boucherie ..... A46D 3/062 300/2

OTHER PUBLICATIONS

"Aspects of Energy Efficiency in Machine Tools," Jan. 1, 2011, retrieved from: http://dfpcorec-p.internal.epo.org/wf/web/citenpl/citenpl.html on Aug. 15, 2013, 8 pages.

* cited by examiner

AUTOMATIC PUNCHING MACHINE FOR MAKING BRUSHES AND METHOD FOR AUTOMATICALLY MAKING BRUSHES BY PUNCHING

BACKGROUND OF THE INVENTION

This invention relates to an automatic punching machine for making brushes and to a method for automatically making brushes by punching.

The invention addresses the technical field of systems for the production of brushes composed of a brush body having a plurality of openings into which bundles of fibers, or bristles, are inserted and fixed.

More specifically, the invention relates to automatic machines for making industrial brushes. The invention, however, also relates to automatic machines for making brushes in general (for example, brushes for dental use).

These machines are equipped with a plurality of movable elements driven in coordinated fashion in a cyclic work sequence. The movable elements act in conjunction to insert and fix the bundles of fibers in the brush body.

More specifically, automatic punching machines have the following movable elements:

- a slide (also known as "punch") movable with reciprocating motion for receiving bundles of fibers and feeding them to a brush body;
- a needle movable with reciprocating motion for inserting the bundles of wires into corresponding openings of the brush body;
- a device (also known as "bow") for removing the bundles of fibers from a tank of these fibers;
- a feeder (also known as "wire feeder") for feeding fixing material (usually consisting of metal wire), acting in conjunction with the slide and with the needle to allow insertion of a quantity of fixing material into the opening of the brush body together with a corresponding bundle of fibers;
- a cutting device (also known as "cutter") designed for cutting portions of fixing material;
- a shaping device (also known as "frame") for shaping fixing elements comprising a predetermined quantity of fixing material;
- a device for separating fibers (also known as "bristle separator").

Each of these movable elements is reciprocatingly driven from a first operating position to a second operating position, in each working cycle (or punching cycle).

Generally speaking, all of the above mentioned movable elements are driven by a single shaft through the agency of a plurality of cams. Thus, there is a motor (for example, an electric motor) which drives the shaft and which, consequently, drives all the movable elements.

This solution guarantees perfect synchrony between the movements of all the movable elements and makes the machine particularly fast.

This "mechanical" solution is not, however, very flexible and suffers from considerable problems if the machine needs to be adapted to making brushes of different sizes, especially with fibers (that is, bristles) of different lengths.

In effect, changing over to brushes with bristles of a different length means adjusting the stroke of one or more of these movable elements. That makes changeovers in a machine of this kind relatively tricky.

In light of this, other technical solutions have been developed where one or more of the movable elements are driven by a dedicated actuator, for example an electric motor used for driving a single movable element.

A solution of this kind is described in patent document EP1493355B1.

Further, to facilitate changeover, the Applicant has developed a technical solution (described in patent document WO2011045743) where the electrical actuators are connected to respective movable elements by kinematic mechanisms which make it easier to adjust the stroke of the movable elements.

These solutions also have drawbacks, however, linked to the difficulty of coordinating and synchronizing the movement of a plurality of movable elements driven by corresponding actuators. This difficulty is emphasized by the need to make the machine particularly efficient in terms of speed and reliable against malfunctions.

Another disadvantage of these solutions is their very high energy consumption.

DISCLOSURE OF THE INVENTION

This invention has for an aim to provide an automatic punching machine for making brushes and a method for automatically making brushes by punching which can overcome the above mentioned disadvantages of the prior art.

More specifically, it is an aim of the invention to provide an automatic punching machine which is particularly flexible in terms of changeover and, at the same time, particularly fast.

A further aim of the invention is to provide an automatic punching machine which, besides being particularly flexible in terms of changeover, is also particularly reliable and robust.

A yet further aim of the invention is to provide an automatic punching machine which, besides being particularly flexible in terms of changeover, is also particularly energy-efficient.

These aims are fully achieved by the machine and method of this invention, as characterized in the appended claims.

More specifically, the punching machine according to the disclosure is an automatic machine for making brushes by punching, comprising:

- a slide connected to a first actuator and movable with reciprocating motion for receiving bundles of fibers and feeding them to a brush body;
- a needle connected to a second actuator and movable with reciprocating motion for inserting the bundles of wires inside corresponding openings of the brush body;
- a control system connected to the first and second actuators for controlling them in a synchronized fashion.

According to the disclosure, the control system comprises:

- a first sensor designed for detecting a first signal representing the position of the slide during movement of the slide;
- a second sensor designed for detecting a second signal representing the position of the needle during movement of the needle;
- a memory containing data of a predetermined trend of at least one control parameter, representing the position of the slide, as a function of a synchronization parameter having a predetermined relationship with a parameter representing the position of the needle;
- a processor designed to receive from the sensors the first and second signals and programmed for deriving in real time values of the synchronization parameter and for controlling at least the first actuator by feedback as a function of the first and second signals, of the values derived for the synchronization parameter and of the data contained in the memory.

It should be noted that the punching machine according to the disclosure comprises a plurality of movable elements.

Preferably, the machine comprises the following movable elements (besides the needle and slide, already mentioned):

- a device for removal of bundles of fibers from a tank of these fibers;
- a feeder of fixing material, acting in conjunction with the slide and with the needle for allowing the insertion of a quantity of fixing material inside the opening of the brush body together with a corresponding bundle of fibers;
- a cutting device designed for cutting portions of fixing material;
- a device for shaping fixing elements comprising a predetermined quantity of fixing material;
- a device for separating fibers.

Preferably, each of these movable elements is controlled by a corresponding actuator (drive).

In light of this, for one or more movable elements (besides the needle and slide already mentioned) the following applies:

- the punching machine comprises a sensor designed for detecting a signal representing the position of the movable element during movement of the movable element,
- the memory contains data of a predetermined trend of at least one control parameter, representing the position of the movable element, as a function of a synchronization parameter having a predetermined relationship with a parameter representing the position of the needle;
- the processor is designed to receive the signal detected by the sensor and it is programmed for controlling the movable element by feedback as a function of the data contained in the memory.

It should be noted that the motion of these movable elements is periodic motion.

More specifically, the operation of the machine defines a working cycle, at the end (or start) of which the movable elements are each at the same respective positions.

The machine according to the disclosure guarantees phase synchronization in the movement of the movable elements thanks to the fact that the movement of one movable element (preferably all the movable elements, or all except one) is controlled (by feedback) relative to a predetermined memorized trend (at least one) which links the position of that movable element to the other movable elements.

This law is defined by the trend of the control parameter (of the corresponding movable element) relative to the synchronization parameter.

For example, the control parameter is a quantity representing the position of the movable element.

Preferably, the control extends to two or more control parameters. Preferably, for each movable element (that is, for each drive of a respective movable element), the position (first control parameter), speed (second control parameter) and acceleration (third control parameter) are controlled (by feedback). Preferably, the control is performed also through a fourth control parameter, namely jerk, (the derivative of acceleration with respect to time).

Thus, as regards the control parameters, the processor compares values derived from a memorized (reference) trend with values derived from a signal detected by a corresponding sensor.

The synchronization parameter, on the other hand, represents the working cycle, that is, a period (for example, 0-360 degrees) corresponding to the working cycle of the punching machine.

Thus, for each of the control parameters of any given movable element, the memory contains a trend (a law of variation) as a function of a period (0-360 degrees) corresponding to the working cycle of the punching machine.

During machine operation, the control system detects a signal representing the instantaneous value of the synchronization parameter to identify, instantaneously, the position of the machine in the period (that is, in the working cycle).

As regards detection of the synchronization parameter (that is, of a signal representing the synchronization parameter), the following two approaches are possible:

- use of a time reference signal (that is, a time base) generated by the machine itself (for example by the processor or other electronic components);
- use of a detected signal representing a control parameter (for example, the position) of one of the movable elements, which thus adopts the role of "master" relative to the other movable elements.

These approaches (with regard to the synchronization parameter) can be used alternatively or in combination according to different embodiments.

Whatever the case, the processor is programmed to derive values of the synchronization parameter (from the synchronization signal).

The time reference signal generated is, for example, a saw tooth signal or any other signal able to define a clock.

Thus, the value adopted instantaneously by the time reference signal is in a biunique relationship with the position in the period (working cycle), for example expressable in sexagesimal degrees by a number between 0 and 360 degrees.

As regards use as synchronization parameter of a detected signal representing a control parameter of one of the movable elements, use of a control parameter of the needle is preferable. Thus, if one of the movable elements is to adopt the role of master, that movable element is preferably the needle.

In effect, the needle is the movable element with the longest stroke. In light of this, generally speaking (although this is not an essential condition), the movement of the needle is continuous, without stops, and is in a biunique relationship with the trend of the machine work cycle.

Thus, the position of the needle (or other quantity linked to the position) may be used effectively as synchronization parameter for the other movable elements. In principle, however, any other movable element can be used instead of the needle.

Thus, to control one or more of the movable elements (that is, the respective actuators thereof), the position of the needle (acting as "master") detected by the second sensor is used as synchronization parameter.

In this case (needle used as master), the needle (that is, the actuator of the needle) may be controlled by feedback relative to the time reference signal, or it may be controlled in open loop.

In the presence of three or more movable elements to be controlled, a first movable element might be used as master (controlled in closed loop based on a time reference generated or controlled in open loop), a second movable element might be used as synchronization parameter for synchronizing the position of the master, and the third movable element might be used as synchronization parameter for synchronizing the position of the second movable element (instead of the position of the master).

In light of this, the important thing is that, for each of the movable elements to be controlled, the synchronization parameter used to control it has a predetermined relationship with a parameter representing the position of the needle. This parameter may be:

- the detected position of the needle itself (the needle is master and the other movable elements are slaves to the needle);
- the position of another movable element which is slave to the needle;
- an absolute time reference (used for all the movable elements); in this case, the absolute time reference has a predetermined relationship with a parameter representing the position of the needle because (in this case) the machine memory contains a relationship which links the position of the needle (or another parameter linked to it such as, for example, the speed or acceleration) to the synchronization parameter (corresponding to the absolute time reference).

In light of this, the needle is also controlled by feedback relative to that time reference signal and all the other movable elements (to be controlled) are controlled relative to the selfsame time reference signal. In that case, the time reference signal is an absolute time reference (absolute time base). Also, in this case, none of the movable elements adopts the role of master.

The fact that the needle is controlled (by feedback) based on that time reference, consisting of a signal generated by the machine, has the advantage of allowing the speed of the machine to be adjusted by operating on the frequency of the time reference signal.

In effect, by increasing or decreasing the frequency of the time reference signal, all the movable elements accelerate or decelerate, while remaining synchronized with each other (this applies whether the time reference is absolute or the time reference is used to control the needle as master for all the other movable elements).

In light of this, the machine has a control unit (for example constituted by the selfsame processor or by other processing means) designed for receiving as input a control signal representing an operating condition of the actuators (for example representing the absorbed power of the actuators).

The control unit is programmed to vary the frequency of the time reference signal as a function of the control signal. For example, the control unit is programmed to reduce the frequency of the time reference signal, causing all the movable elements to decelerate, if the control signal it receives indicates an overload condition of one of the actuators (for example because of a mechanical fault in the corresponding movable element preventing the respective actuator from keeping up with the other actuators).

Another advantage of controlling the needle (by feedback) based on the time reference, consisting of a signal generated by the machine, is that it allows a machine shutdown procedure to be managed in a simple and effective manner.

Preferably, the control system (that is, the processor of the control system) is programmed to set, at machine start-up (when the movable elements are stationary and must be set in motion), a predetermined initial value for the synchronization parameter as a function of a value detected by the second sensor (at an instant the machine is started).

This allows synchronizing all the drives of all the movable elements when the machine is started up, taking as reference the position of one of the movable elements (preferably the needle, for the reasons stated above).

One advantage of using the time reference as absolute time base for controlling all the movable elements is that it allows maximum freedom in defining the drive cycle of the needle, giving the possibility of assigning one or more stops to the needle. This may be useful to optimize machine operation, even after a changeover (which means varying the stroke of one or more of the movable elements).

The actuators comprise respective motor systems, preferably electrical and preferably rotary electrical machines.

Alternatively, the motor systems might be linear actuators, or they might be pneumatic actuators.

Whatever the case, the actuators are controllable individually (through an electric signal or other signal manageable by an electronic control unit).

At least two (preferably all) of the actuators are designed for moving a respective movable element, that is to say, are dedicated to driving the movable element.

The kinematic connection between the actuators and the respective movable elements may be of any type.

Preferably, the needle is connected to a rotary motor system through a thrust crank mechanism. A crank and conrod system may also be used for the other actuators.

It should be noted, however, that other types of actuators, such as, for example, linear actuators may be used instead of a rotary electric actuator.

The kinematic mechanism used to connect the actuator to the movable element might be of a type other than the crank mechanism, such as, for example, conrods, cams, four-bar linkages or other known mechanical solutions.

It should be noted that the actuators of the movable elements preferably comprise electrical machines.

These electrical machines are reversible electrical machines. In other words, they may act as motors (which absorb electrical energy and provide mechanical energy) or as generators (which absorb mechanical energy and generate electrical energy).

According to another aspect of this disclosure, the actuators of two or more (preferably all) of the movable elements have electrically interconnected power supplies. Preferably, the power supplies are connected to each other by a single conductor (bus).

Preferably, each actuator comprises an electrical machine (for example, a brushless motor) and a converter designed for driving the electrical machine (preferably, a DC/AC converter). The converter defines a servo-drive (also called simply "servo" or "drive" for short).

In light of this, preferably, the converters are all connected to the same direct current (DC) bus which constitutes a common power supply for all the servo-drives.

In light of this, the control system is programmed to drive the actuators operating as motors or generators, as a function of an instantaneous operating state of acceleration or deceleration of each electrical machine, respectively. Thus, the electrical energy supplied by an actuator operating as a generator can be used by another actuator operating as a motor.

One actuator can operate as a motor and another can simultaneously operate as a generator because the movements of the movable elements are synchronized in such a way as to allow one element to accelerate while another is decelerating.

That means less energy is absorbed, the machine consumes less and is more energy-efficient.

The machine preferably also comprises an electrical energy accumulator (for example, a capacitor battery) connected to the bus. This allows the energy generated by an actuator to be used (recovered) after some time by another actuator or by that same actuator.

It should also be noted that the machine is configured to feed the energy recovered (thanks to operation of the actuators as generators) into the electricity grid.

Preferably, the control system is programmed to perform a controlled shutdown procedure. More specifically, it is programmed to drive the actuators (all those connected to movable elements which are in motion when the controlled shutdown procedure starts) in such a way that the respective electrical machines decelerate simultaneously until the movable elements come to a stop at predetermined reciprocal positions. This guarantees that the movable elements remain synchronized with each other at all times.

Preferably, the control system is programmed to drive the actuators in such a way that, during the controlled shutdown procedure, all the electrical machines operate in generator mode.

Thus, the machine according to the disclosure is capable of effectively managing an emergency stop procedure in the event of a power cut (and in the absence of auxiliary generator systems, that is, uninterruptible power supplies—UPS—or emergency power units, connected to the individual actuators).

In effect, during such a procedure (while the electrical machines are decelerating), the bus receives energy from the actuators themselves. This energy (together with energy previously accumulated, if any) is used to bring all the movable elements to a complete stop at predetermined (desired) reciprocal positions.

Thus, the machine is configured to manage the controlled shutdown procedure in such a way as to use previously accumulated energy and the energy produced by the electrical machines of the actuators operating as generators.

In light of this, the control system also has a power supply which is interconnected with the power supplies of the actuators (preferably connected to the DC bus) so that it uses the electrical energy generated by the actuators themselves. The control system, however, is preferably powered through a UPS.

It should also be noted that the control system receives as input a signal representing the voltage of the mains power supply and a signal representing the voltage of the DC bus. The control system is programmed to monitor the supply voltage (supplied by the mains grid) and the voltage of the DC bus and to automatically activate the controlled shutdown procedure as a function of a predetermined criterion based on these voltage signals. The machine is thus configured to perform the controlled shutdown procedure automatically.

This disclosure also provides a method for automatically making brushes by punching.

This method comprises the following steps:

- moving a slide using a first actuator, with reciprocating motion for receiving bundles of fibers and feeding them to a brush body;
- moving a needle using a second actuator and movable with reciprocating motion for inserting the bundles of wires inside corresponding openings of the brush body.

According to the disclosure, the method further comprises the following steps:

- preparing a memory containing data of a predetermined trend of at least one control parameter, representing the position of the slide, as a function of a synchronization parameter having a predetermined relationship with a parameter representing the position of the needle;
- detecting a first signal representing the position of the slide during movement of the slide;
- detecting a second signal representing the position of the needle during movement of the needle;
- feedback control of the first actuator as a function of the stored data of a predetermined trend of at least one control parameter, representing the position of the slide, with respect to a synchronization parameter having a predetermined relationship with a parameter representing the position of the needle, and as a function of the first and second signal detected and of values derived in real time for the synchronization parameter.

More specifically, the method comprises the moving in an alternating fashion, using corresponding actuators, of (one or more of) the following movable elements;

- a device for removal of bundles of fibers from a tank of these fibers;
- a feeder of fixing material, acting in conjunction with the slide and with the needle for allowing the insertion of a quantity of fixing material inside the opening of the brush body together with a corresponding bundle of fibers;
- a cutting device designed for cutting portions of fixing material;
- a device for shaping fixing elements comprising a predetermined quantity of fixing material;
- a device for separating fibers.

In light of this, the method preferably comprises the following steps:

- detecting a second signal representing the position of the movable element during movement of the movable element;
- feedback control of the actuator of the movable element, as a function also of a predetermined trend of at least one control parameter, representing the position of the movable element, with respect to the synchronization parameter (having a predetermined relationship with a parameter representing the position of the needle).

Preferably, the second actuator is controlled by feedback as a function of a predetermined trend of at least one control parameter representing the position of the needle with respect to a time reference signal generated by the processor.

In this case, all the actuators are preferably controlled by feedback as a function of respective trends of at least one control parameter with respect to the synchronization parameter, the synchronization parameter consisting of the time reference signal generated by the processor (used to control the needle and defining an absolute time base).

The method preferably also comprises a step of dynamically adjusting the time reference signal, as a function of a control signal representing an operating condition of the actuators.

Preferably, the method further comprises a step of setting an initial predetermined value for the synchronization parameter, as a function of a value detected by the second sensor at an instant the machine is started.

According to another aspect of the disclosure, the actuators comprise reversible electrical machines having respective power supplies which are electrically interconnected and the method comprises the following steps:

- supplying electricity for powering at least one actuator operating as a motor;
- receiving and accumulating electricity from at least one actuator operating as a generator, for using the electricity in a supply step.

BRIEF DESCRIPTION OF THE DRAWINGS

These and other features will become more apparent from the following detailed description of a preferred, non-limiting embodiment of the disclosure, with reference to the accompanying drawings, in which.

DETAILED DESCRIPTION

Figure 1:
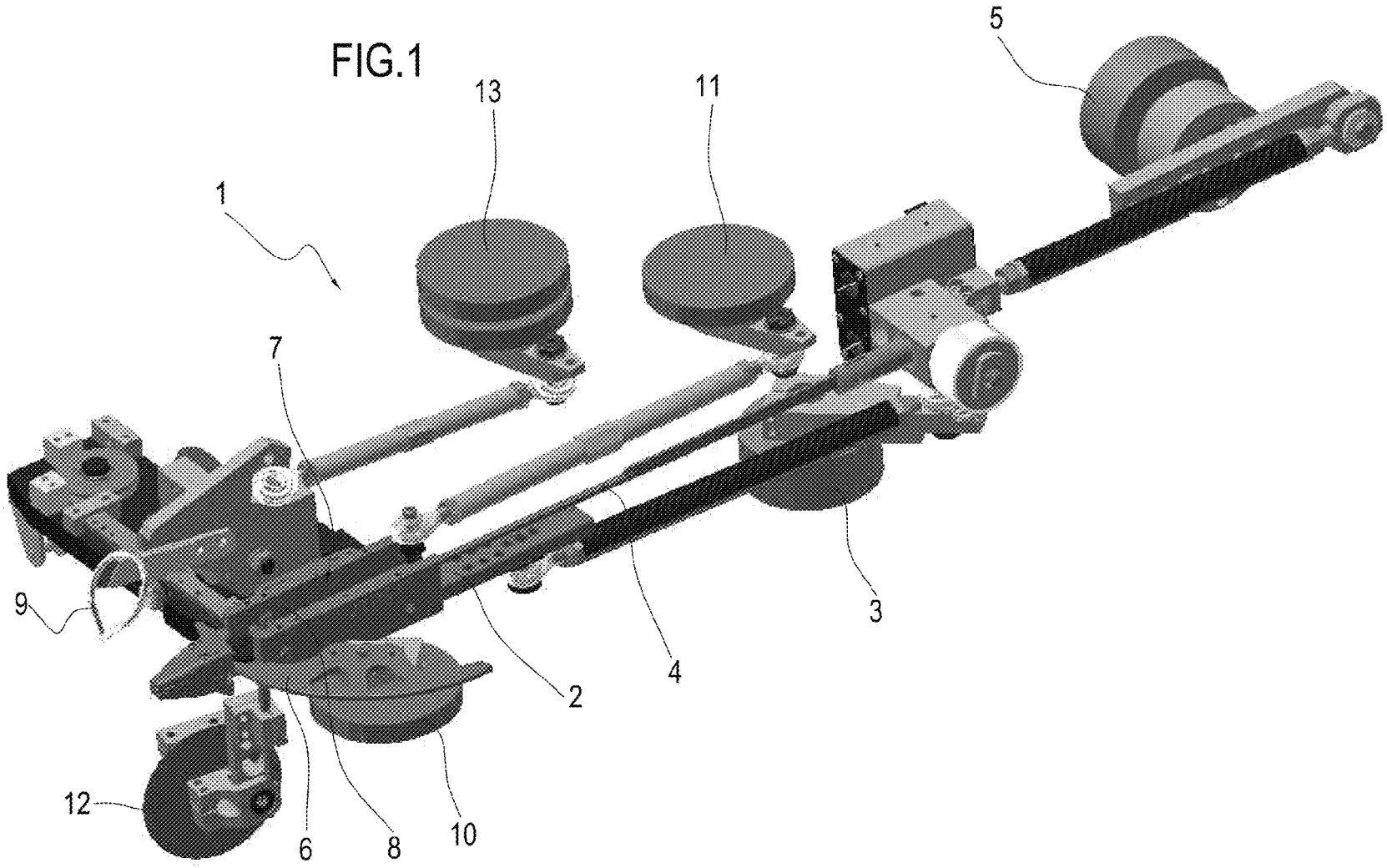
FIG. 1 schematically illustrates the punching machine according to the disclosure.

The numeral 1 in the drawings denotes a machine according to this disclosure.

The machine 1 is an automatic punching machine for making brushes (in particular industrial brushes but not necessarily, and not necessarily and exclusively, industrial brushes).

These brushes, of known type and not illustrated in the drawings, have a brush body defining a plurality of openings and bundles of fibers connected to the brush body in the openings.

The machine 1 comprises a slide 2 movable with reciprocating motion for receiving bundles of fibers and feeding them to a brush body.

The slide moves along longitudinal axis (punching axis).

The slide 2 is connected to a first actuator 3.

Preferably, the first actuator 3 is an electrical machine (for example, a brushless motor).

In the example illustrated, the electric motor (of the first actuator 3) has an axis of rotation which is perpendicular to the longitudinal (punching) axis.

Preferably, the slide 2 is connected to the respective actuator 3 by a crank and conrod system.

The machine 1 also comprises a needle 4 movable with reciprocating motion for inserting the bundles of wires into the openings of the brush body.

The needle 4 is movable along the longitudinal (punching) axis.

The needle 4 is connected to a second actuator 5 designed for driving the needle 4 itself.

Preferably, the second actuator 5 is an electric motor (for example, a brushless motor).

In the example illustrated, the electric motor (of the second actuator 5) has an axis of rotation which is perpendicular to the longitudinal (punching) axis. Also, preferably, the axis of rotation of the electric motor of the second actuator 5 is perpendicular to the axis of rotation of the electric motor of the first actuator 3.

Preferably, the needle 4 is connected to the respective actuator 5 by a crank and conrod system.

The machine 1 comprises other movable elements, besides the slide 2 and the needle 4. These further movable elements act in conjunction with the slide 2 and needle 4 to perform punching. All these elements move with periodic motion according to a working cycle.

More specifically, the machine 1 comprises the following further movable elements:

- a device 6 for removal of bundles of fibers from a tank (not illustrated) of these fibers;
- a feeder (not illustrated) of fixing material, acting in conjunction with the slide 2 and with the needle 4 for allowing the insertion of a quantity of fixing material inside the opening of the brush body together with a corresponding bundle of fibers;
- a cutting device 7 designed for cutting portions of fixing material;
- a device 8 for shaping fixing elements comprising a predetermined quantity of fixing material;
- a device 9 for separating the fibers, The device 6 for removing the bundles of fibers is connected to a respective third actuator 10.

The feeder of fixing material is connected to a respective fourth actuator (not illustrated).

The cutting device 7 is connected to a respective fifth actuator 11.

The shaping device 8 is connected to a respective sixth actuator 12.

The separating device 9 is connected to a respective seventh actuator 13.

The machine 1 also comprises a control system 14 designed for controlling (and synchronizing) the actuators of the machine 1.

Thus, the control system 14 is connected to the first actuator 3 and to the second actuator 5 for driving them in a synchronized fashion.

The control system 14 is preferably also connected to one or more (still more preferably, to all) of the other actuators, from the third to the seventh, in order to drive them in a synchronized fashion.

The machine 1 further comprises, for each actuator (connected to the control system 14 in order to be controlled by it), at least one sensor (not illustrated, of essentially known type), designed to detect a signal representing the position of the corresponding movable element during movement of the movable element.

More specifically, therefore, the control system 14 comprises a first sensor designed for detecting a first signal representing the position of the slide 2 (during movement of the latter), and comprises a second sensor designed for detecting a second signal representing the position of the needle 4 (during movement of the latter).

It should be noted that these sensors may operate on the corresponding movable element (directly) or on the actuator connected to the movable element in order to move it.

For example, the sensor may be an accelerometer connected to the movable element or it may be an encoder connected to the shaft of the electrical machine of the actuator. Other solutions known in the sector of control systems may also be used, however.

More specifically, for each movable element, a plurality of sensors are preferably used: for example, one designed to detect (directly) a signal representing the position of the respective movable element, one designed to detect (directly) a signal representing the speed of the respective movable element and one designed to detect (directly) a signal representing the acceleration of the respective movable element.

It should be noted that a signal representing the speed of a movable element also (indirectly) represents the position of that movable element (since it can be integrated by a processor of the control system 14).

The fact, however, that signals representing the position and the speed are detected by respective dedicated sensors increases the reliability of the control.

The control system 14 comprises (or at least has access to) a memory containing data useful for controlling the actuators.

For each movable element controlled, the memory comprises data of a predetermined trend of at least one control parameter, representing the position of that movable element, as a function of a synchronization parameter representing the period corresponding to the working cycle of the machine 1.

For example, this trend is memorized as a function of a variable expressed in sexagesimal degrees and falling within the range [0-360], or expressed in radians and falling within the range [0-2π].

The control system 14 also comprises a processor (that is, processing means) designed for receiving the signals detected by the sensors. More specifically, the processor is designed for receiving from the second sensor the second signal representing the position of the needle 4.

The processor is also designed for receiving from the first sensor the first signal representing the position of the slide 2 (and the other signals detected by the other sensors and representing the positions of the other movable elements, or any subset thereof).

The processor is programmed to receive or derive (in real time) a corresponding signal (representing the trend over time of the synchronization parameter), that is, a synchronization signal.

This synchronization signal has a predetermined relationship with a parameter representing the position of the needle. Thus, the synchronization parameter has a predetermined relationship with a parameter representing the position of the needle.

For example, the synchronization signal is the second signal detected by the second sensor, and/or the synchronization signal is a time reference signal generated by the processor (for example, a saw tooth or other signal having a periodic trend according to the working cycle of the machine and having a monotonic trend in the period of that cycle).

Thus, the processor is programmed to derive a value of the synchronization parameter, at each instant, as a function of the synchronization signal.

The processor is programmed to control at least the first actuator 3 by feedback as a function of the data contained in the memory. In effect, at each instant (or rather, in a succession of instants at predetermined time intervals) the processor derives the value of the synchronization parameter from the synchronization signal and derives, as a function of that value of the synchronization parameter and of the data contained in the memory, a reference value for the control parameter (or a plurality of control parameters). The processor compares the reference value for the control parameter with the value of the same parameter detected (by the corresponding sensor) and generates a signal for driving the corresponding actuator, as a function of the comparison.

Preferably, the processor is programmed, according to what is described above, to control also the other actuators (third, fourth, fifth, sixth and seventh actuators) or any subset of the actuators.

Preferably, therefore, for each of the movable elements, the punching machine 1 comprises a sensor configured to detect a signal representing the position of the movable element during the movement thereof and the memory contains data of a predetermined trend of at least one corresponding control parameter, representing the position of the movable element, as a function of a synchronization parameter having a predetermined relationship with a parameter representing the position of the needle.

The operation of the control system 14 is described in further detail below.

For convenience of description, the need to coordinate the drive of the slide 2 relative to the drive of the needle 4 is considered (a similar consideration would also apply to the other movable elements).

For controlling the slide 2, the memory contains a predetermined trend of a control parameter Yslide as a function of the period (for example 0-360 degrees) which corresponds to the synchronization parameter Xslide.

For example, the control parameter Yslide is the position of the slide (or a quantity representing that position).

In a first embodiment, the synchronization parameter Xslide is a time reference. The time reference signal therefore defines the synchronization parameter.

Thus, at a given instant, as a function of the value of the time reference signal and, hence, of the synchronization parameter (Xslide) the processor knows what the value of the control parameter for the slide (Yslide) should be, based on the trend Yslide-Xslide stored in the memory. The processor thus controls the slide actuator by feedback as a function of comparison between the detected value for the slide control parameter and the corresponding value stored in the memory.

In this example, the actuator of the needle is controlled (by feedback) as a function of the stored trend (law) of a control parameter Yneedle (for example, the position of the needle) as a function of the period (for example 0-360 degrees), which corresponds to the synchronization parameter Xneedle. The processor uses the same time reference signal as used for controlling the slide (the synchronization parameter) to determine instantaneously the value of the parameter Xneedle.

In a second embodiment, the needle is controlled by feedback as a function of the time reference signal (defining the synchronization parameter for the needle), as in the first embodiment, but the slide is controlled as a function of the position of the needle, that is, of the control parameter Yneedle.

In this case, the processor derives the instantaneous value of the period (Xslide) from the instantaneous value of the detected position of the needle (which is in turn controlled as a function of the time reference signal).

In practice, in this case, slide drive is slave to needle drive.

In a third embodiment, the needle is controlled in open loop and the slide is controlled as a function of the position of the needle (instantaneously detected by the corresponding sensor). In this case, the processor derives the instantaneous value of the period (Xslide) from the instantaneous value of the detected position of the needle (which, instead, is controlled in open loop).

It should be noted that each actuator comprises a motor system (preferably an electrical machine, and more preferably, a brushless motor, or a linear actuator or other motor system) and a servo-drive connected to the motor system in order to drive it.

Figure 2:
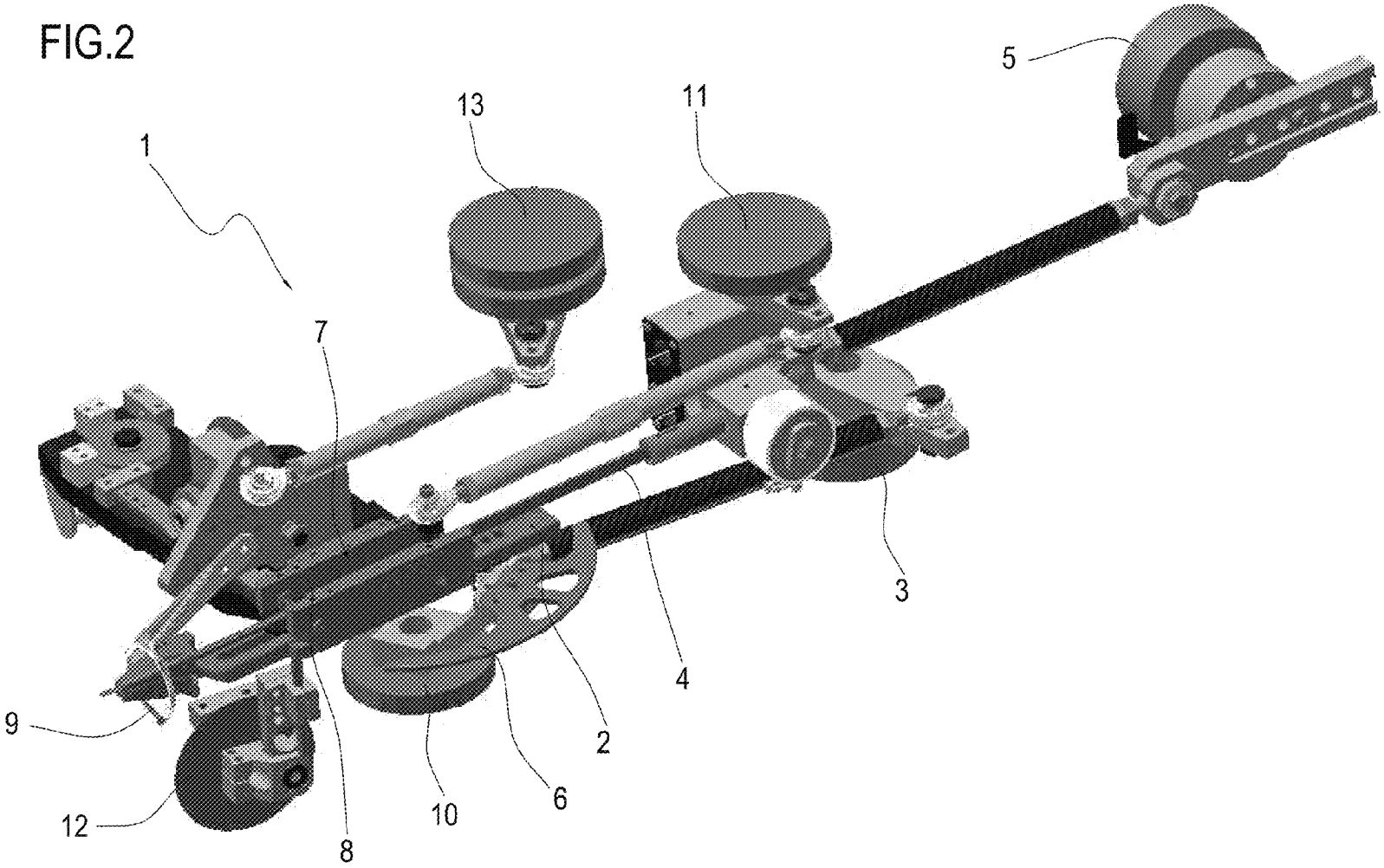
FIG. 2 illustrates the punching machine of FIG. 1, in a different operating configuration.

Notice in FIGS. 1 and 2 the mechanical components of the machine 1, in particular the movable elements, the motor systems designed for moving the movable elements and the kinematic mechanisms for connecting the movable parts to the respective motor systems.

Figure 3:
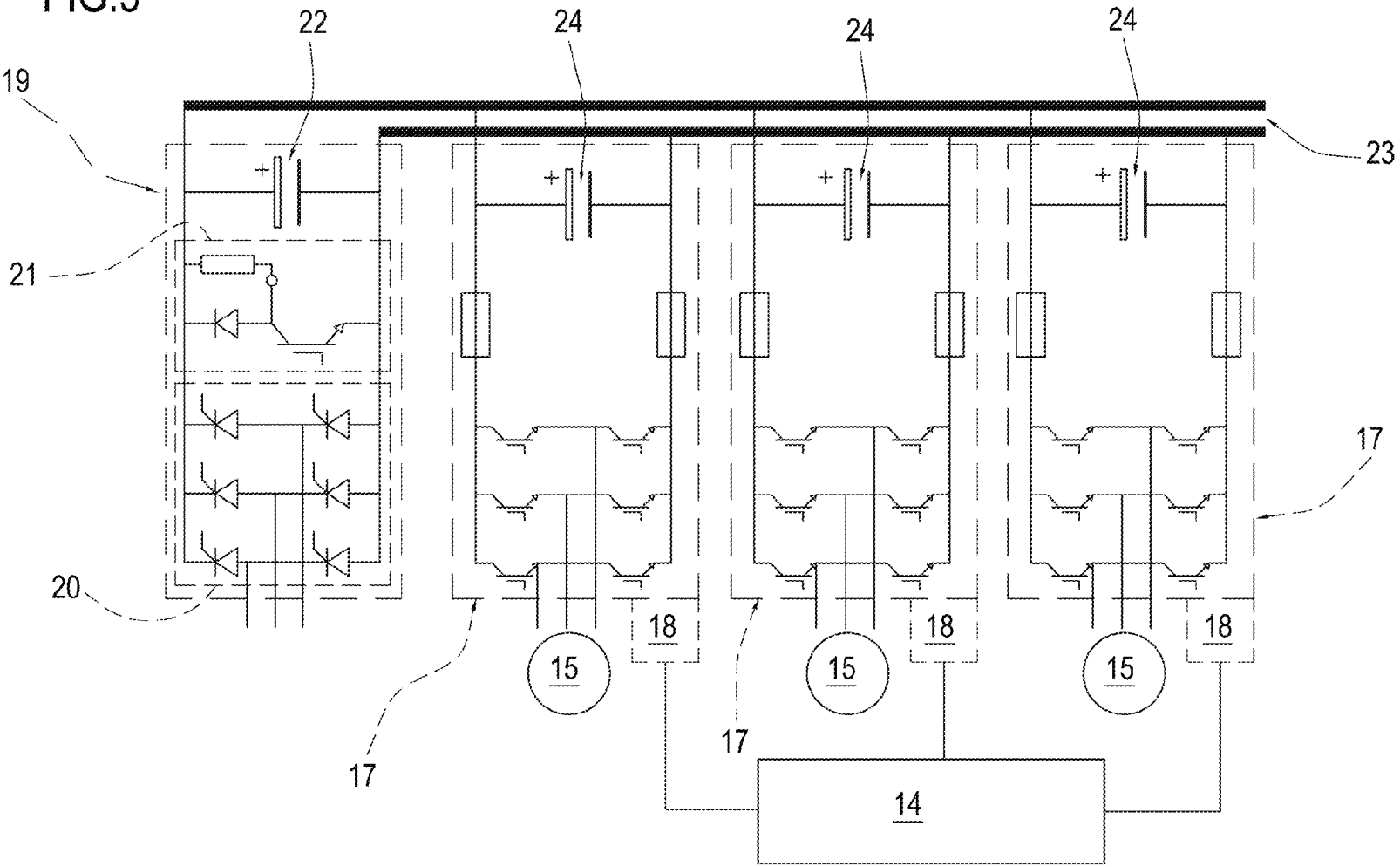
FIG. 3 shows a wiring diagram of the actuators of the machine according to the disclosure.
Figure 4:
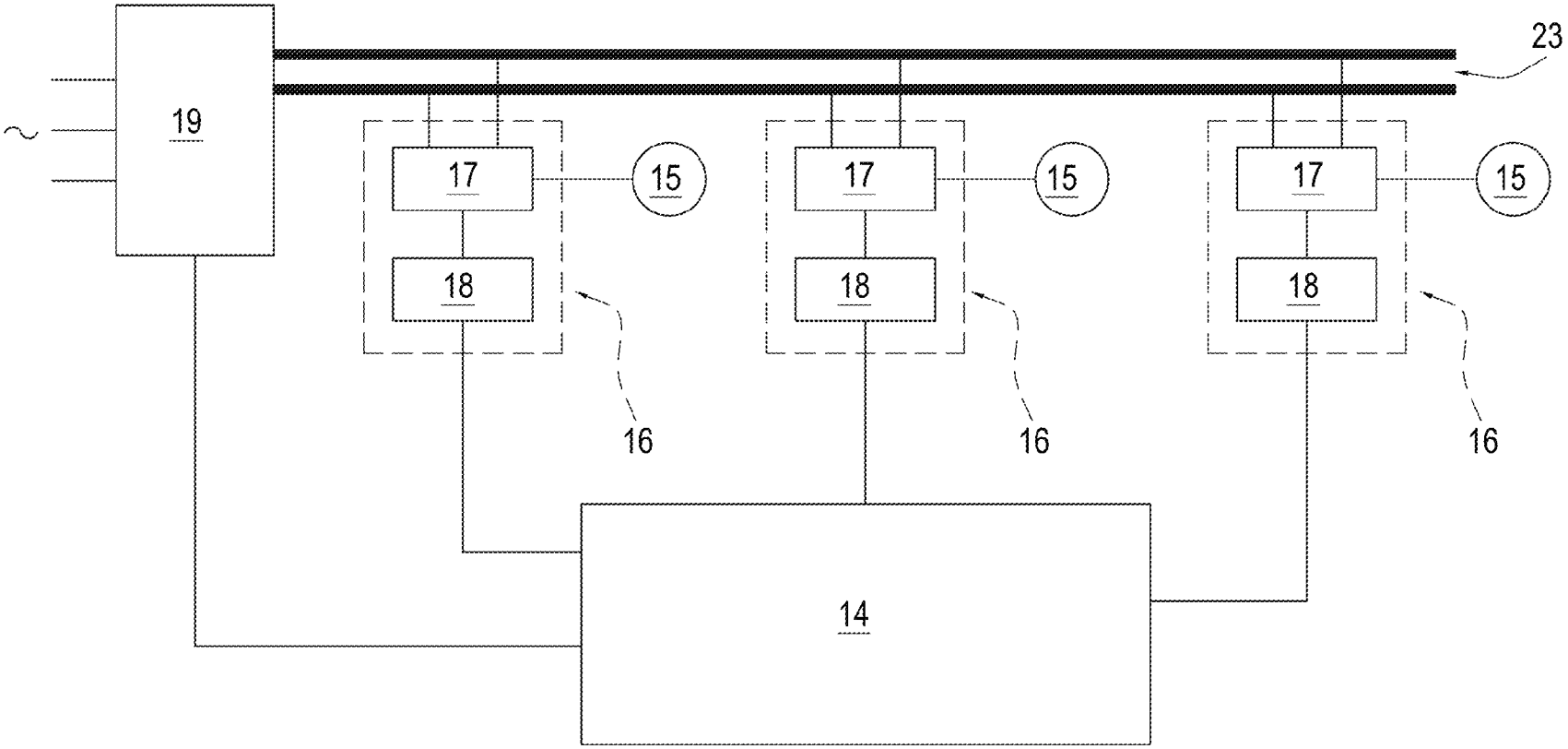
FIG. 4 shows a functional diagram of the machine of FIG. 1.

FIGS. 3 and 4, on the other hand, illustrate (schematically) the control and electrical parts of the machine, in particular the servo-drives, the control system 14 and their power supply system.

In FIGS. 3 and 4, the motor systems are denoted in their entirety by the numeral 15, whilst the servo-drives are denoted in their entirety by the numeral 16.

For simplicity, not all the actuators (which are preferably seven), but only a subset of them, are shown in FIGS. 3 and 4 because from a functional viewpoint (that is, with regard to the connection to the electrical power supply and to the control system 14) all the actuators have the same structure.

Each servo-drive 16 comprises a power converter 17 and an electronic card 18.

Each servo-drive 16 is connected to an electrical power supply, to the control system 14 and to the corresponding motor system 15.

More specifically, for each servo-drive 16, the power converter is connected to the electrical power supply and to the corresponding motor system 15. The electronic card 18 is connected to the electrical power supply and to the control system 14.

Preferably, the motor systems 15 are three-phase brushless motors.

Preferably, the electrical power supply system is made as follows.

The machine 1 comprises a power unit 19 connected to the mains power supply (three-phase).

The power unit 19 is preferably connected to all the actuators to power them.

More specifically, each servo-drive 16 is connected to the power unit 19.

Preferably, the control system 14 is connected to the power unit 19.

The power unit 19 comprises a rectifier 20 (preferably of controllable type, such as, for example, a thyristor or transistor bridge) configured to receive the three-phase mains voltage and to supply a direct current voltage as output.

Preferably, the power unit 19 comprises, downstream of the rectifier 20, a safety device 21 used to dissipate current at the output terminals of the rectifier 20.

Also, preferably, the power unit 19 comprises a capacitor 22 connected to the output terminals of the power unit itself.

Thus, the power unit 19 is connected to a DC bus (that is, a direct current bus) 23 which defines a common power supply for all the actuators.

Preferably, the machine comprises a plurality of further capacitors 24. Preferably, for each servo-drive 16, a capacitor 24 is connected in parallel to the other capacitors (and to the capacitor 22 of the power unit 19) to define a battery of capacitors connected to the DC bus 23.

Preferably, each converter 17 is a DC/AC converter controlled by sinusoidal PWM logic.

Preferably, all the servo-drives 16 (in particular, all the cards 18) are connected to the control system 14 for them to be controlled (driven).

According to another aspect of the disclosure, the control system 14 is programmed to drive the actuators operating as motor or generator (of the corresponding motor system 15, which is preferably a brushless electrical machine) as a function of an instantaneous operating state of acceleration or deceleration of each electrical machine, respectively, so that the electrical energy supplied by one actuator operating as generator can be used by another actuator operating as motor.

Preferably, the control system 14 is programmed to perform a controlled emergency shutdown procedure. More specifically, it is programmed to drive all the actuators in such a way as to cause the respective electrical machines (in particular those that are in motion) to decelerate simultaneously in generator operating mode to bring the movable elements to a stop at predetermined reciprocal positions.

Preferably, therefore, the control system 14 is programmed to perform a controlled emergency shutdown procedure in such a way as to cause the motor systems 15 to operate as generators during their deceleration.

Thus, during the emergency stop, the control system 14 causes all the tools (except those that have already stopped when the procedure starts) to decelerate, thereby operating as generators and keeping the bus 23 supplied with power so that it in turn supplies the servo-drive 16 (and the actuators in general) for long enough to bring all the movable elements to a complete stop in phase-coordinated fashion.

The fact that the control system 14 drives the motor systems 15 to operate as electrical power generators during deceleration of the respective movable elements advantageously makes it possible to recover energy by transferring electrical energy to the bus 23.

That allows the machine 1 to absorb less power from the mains and (in the absence of voltage from the mains) to perform emergency shutdown procedures without providing the machine 1 with a plurality of UPS units.

The fact that the machine 1 is equipped with a battery of capacitors 24, 22 connected to the bus 23, makes it possible to accumulate electrical energy produced by the actuators themselves or by other actuators at different stages of the working cycle.

What is claimed is:

1. An automatic punching machine for making brushes, comprising:

a slide connected to a first actuator and movable with reciprocating motion for receiving bundles of fibers and feeding them to a brush body;

a needle connected to a second actuator and movable with reciprocating motion for inserting the bundles of fibers inside corresponding openings of the brush body;

a control system connected to the first and second actuators for controlling them in a synchronized fashion, wherein the control system comprises:

a first sensor designed for detecting a first signal representing the position of the slide during movement of the slide;

a second sensor designed for detecting a second signal representing the position of the needle during movement of the needle;

a memory containing data of a predetermined trend of at least one control parameter, representing the position of the slide, as a function of a synchronization parameter having a predetermined relationship with a parameter representing the position of the needle;

a processor designed to receive from the sensors the first and second signals and programmed for deriving in real time values of the synchronization parameter and for controlling at least the first actuator by feedback as a function of the first and second signals detected, of the values derived for the synchronization parameter and of the data contained in the memory.

2. The punching machine according to claim 1, comprising one or more of the following movable elements, movable in a periodic fashion and controlled by corresponding actuators:

a device for removal of bundles of fibers from a tank of these fibers;

a feeder of fixing material, acting in conjunction with the slide and with the needle for allowing the insertion of a quantity of fixing material inside the opening of the brush body together with a corresponding bundle of fibers;

a cutting device designed for cutting portions of fixing material;

a device for shaping fixing elements comprising a predetennined quantity of fixing material;

a device for separating fibers, wherein, for each of the one or more movable elements, the punching machine comprises a sensor designed for detecting a signal representing the position of the movable element during movement of the movable element, the memory contains data of a predetermined trend of at least one control parameter, representing the position of the movable element, as a function of a synchronization parameter having a predetermined relationship with a parameter representing the position of the needle;

the processor is designed to receive the signal detected by the sensor and it is programmed for controlling the movable element by feedback as a function of the data contained in the memory.

3. The punching machine according to claim 1, wherein the memory contains data of predetermined trends of at least a first, a second and third control parameter, as a function of the synchronization parameter, wherein the first control parameter is a position parameter, the second control parameter is a speed parameter and the third parameter is an acceleration parameter, and wherein the machine comprises corresponding sensors, each designed to detect a signal representing the quantity relative to the corresponding parameter.

4. The punching machine according to claim 1, wherein the memory contains data of a predetermined trend of at least one control parameter representing the position of the needle as a function of the synchronization parameter, and wherein the processor is programmed for generating a time reference signal and deriving the values of the synchronization parameter from the signal generated, and wherein the processor is programmed for controlling the second actuator by feedback as a function of the data contained in the memory.

5. The punching machine according to claim 4, wherein the processor is programmed for controlling all the actuators as a function of the values of the synchronization parameter derived from the generated time reference signal.

6. The punching machine according to claim 4, wherein the processor is programmed for deriving values of the synchronization parameter in real time starting from the second signal detected.

7. The punching machine according to claim 4, wherein the processor is programmed for dynamically varying the time reference signal, as a function of a control signal received as input from the processor and representing an operating condition of the actuators.

8. The punching machine according to claim 1, wherein the processor is programmed for deriving values of the synchronization parameter in real time starting from the second signal detected and wherein the processor is programmed for controlling the second actuator in open loop.

9. The punching machine according to claim 1, wherein the processor is programmed for setting an initial predetermined value for the synchronization parameter, as a function of a value detected by the second sensor at an instant the machine is started.

10. The punching machine according to claim 1, wherein the actuators comprise reversible electrical machines having respective power supplies electrically interconnected, and wherein the control system is programmed for controlling the actuators during operation as a motor or as a generator, as a function of an instantaneous operation of each electrical machine for acceleration or deceleration, respectively, such that the electricity supplied by an actuator operating as a generator can be used by another actuator operating as a motor.

11. An automatic punching machine for making brushes, comprising:

a slide connected to a first actuator and movable with reciprocating motion for receiving bundles of fibers and feeding them to a brush body;

a needle connected to a second actuator and movable with reciprocating motion for inserting the bundles of fibers inside corresponding openings of the brush body;

a control system connected to the first and second actuators for controlling them in a synchronized fashion, wherein the control system comprises:

a first sensor designed for detecting a first signal representing the position of the slide during movement of the slide;

a second sensor designed for detecting a second signal representing the position of the needle during movement of the needle;

a memory containing data of a predetermined trend of at least one control parameter, representing the position of the slide, as a function of a synchronization parameter representative of a duty cycle of the punching machine;

a processor designed to receive from the sensors the first and second signals and programmed for deriving in real time values of the synchronization parameter and for controlling at least the first actuator by feedback as a function of the first and second signals detected, of the values derived for the synchronization parameter and of the data contained in the memory.

12. The punching machine according to claim 11, wherein the synchronization parameter has a predetermined relationship with a parameter representing the position of the needle.

13. An automatic punching machine for making brushes, comprising:

a slide connected to a first actuator and movable with reciprocating motion for receiving bundles of fibers and feeding them to a brush body;

a needle connected to a second actuator and movable with reciprocating motion for inserting the bundles of fibers inside corresponding openings of the brush body;

a control system connected to the first and second actuators for controlling them in a synchronized fashion, the actuators comprising reversible electrical machines, wherein the actuators are electrical machines and have respective power supplies electrically interconnected;

the control system is programmed for controlling each of the actuators to operate as a motor during acceleration and to operate as a generator during deceleration, as a function of an instantaneous operation of each of the actuators, such that the electricity supplied by one of the actuators operating as a generator can be used by the other of the actuators operating as a motor;

wherein one of the actuators can operate as a motor and the other of the actuators can simultaneously operate as a generator, because the movements of the slide and the needle are synchronized in such a way as to allow the slide to accelerate while the needle is decelerating and vice versa.

14. The punching machine according to claim 13, comprising one or more of the following movable elements, movable in a periodic fashion and controlled by corresponding actuators:

a device for removal of bundles of fibers from a tank of these fibers;

a feeder of fixing material, acting in conjunction with the slide and with the needle for allowing the insertion of a quantity of fixing material inside the opening of the brush body together with a corresponding bundle of fibers;

a cutting device designed for cutting portions of fixing material;

a device for shaping fixing elements comprising a predetermined quantity of fixing material;

a device for separating fibers, wherein the actuator of each of the one or more movable elements comprises a reversible electrical machine and has a respective power supply interconnected with the power supplies of the other actuators of the one or more movable elements, and wherein the control system is connected to each actuator of the one or more movable elements and programmed for controlling it as a motor or as a generator, as a function of the instantaneous operation for acceleration or deceleration, respectively, of the respective electrical machine.

15. The punching machine according to claim 13, wherein each of the actuators comprises a servo drive having an output connected to the corresponding electrical machine for controlling it and an input connected to an electrical power supply shared by all the servo drives.

16. The punching machine according to claim 15, wherein the servo drives are supplied in DC and the shared electrical power supply comprises a DC bus.

17. The punching machine according to claim 13, wherein the control system is programmed for controlling the actuators in order to control the respective electrical machines for simultaneous deceleration when it is operating as a generator, and for stopping the movable elements in predetermined reciprocal positions.

18. An automatic punching machine for making brushes, comprising:

a slide connected to a first actuator and movable with reciprocating motion for receiving bundles of fibers and feeding them to a brush body;

a needle connected to a second actuator and movable with reciprocating motion for inserting the bundles of fibers inside corresponding openings of the brush body;

a control system connected to the first and second actuators for controlling them in a synchronized fashion, the actuators comprising reversible electrical machines, wherein the actuators have respective power supplies electrically interconnected;

the control system is programmed for controlling the actuators during operation as a motor or as a generator, as a function of an instantaneous operation of each electrical machine for acceleration or deceleration, respectively, such that the electricity supplied by an actuator operating as a generator can be used by another actuator operating as a motor, wherein the control system comprises:

a first sensor designed for detecting a first signal representing the position of the slide during movement of the slide;

a second sensor designed for detecting a second signal representing the position of the needle during movement of the needle;

a memory containing data of a predetermined trend of at least one control parameter, representing the position of the slide, as a function of a synchronization parameter having a predetermined relationship with a parameter representing the position of the needle;

a processor designed to receive from the sensors the first and second signals and programmed for deriving in real time values of the synchronization parameter and for controlling at least the first actuator by feedback as a function of the first and second signals, the values derived for the synchronization parameter and the data contained in the memory.

19. The punching machine according to claim 18, wherein, for each of the slide and the needle, the control system comprises a sensor designed for detecting a signal representing the position of the respective one of the slide and the needle during movement of the respective one of the slide and the needle, the memory contains data of a predetermined trend of at least one control parameter, representing the position of the respective one of the slide and the needle, as a function of a synchronization parameter having a predetermined relationship with a parameter representing the position of the needle;

the processor is designed to receive the signal detected by the sensor and it is programmed for controlling the respective one of the slide and the needle by feedback as a function of the data contained in the memory.

20. The punching machine according to claim 18, wherein said synchronization parameter is representative of a duty cycle of the punching machine.

* * * * *